US006615822B2

(12) United States Patent
Moreau et al.

(10) Patent No.: US 6,615,822 B2
(45) Date of Patent: Sep. 9, 2003

(54) GAS COOKING APPLIANCE

(75) Inventors: André Moreau, Tours (FR); Christophe Trochou, Esvres sur Indre (FR)

(73) Assignee: Sourdilon (FR)

( * ) Notice: Subject to any disclaimer, the term of this patent is extended or adjusted under 35 U.S.C. 154(b) by 0 days.

(21) Appl. No.: 10/124,585

(22) Filed: Apr. 17, 2002

(65) Prior Publication Data

US 2002/0157658 A1 Oct. 31, 2002

(30) Foreign Application Priority Data

Apr. 18, 2001 (FR) ..... 01 05231

(51) Int. Cl.[7] ..... F24C 3/00
(52) U.S. Cl. ..... 126/39 R; 431/354
(58) Field of Search ..... 126/39 R, 41 R, 126/39 E, 39 J, 39 B; 431/354, 355; 239/591, 600

(56) References Cited

U.S. PATENT DOCUMENTS 4,627,411 A * 12/1986 Mertler ..... 126/39 R
5,249,958 A * 10/1993 Freber ..... 431/354
5,325,842 A * 7/1994 Beach et al. ..... 126/39 R
6,173,708 B1 * 1/2001 Arntz et al. ..... 126/39 R

FOREIGN PATENT DOCUMENTS

| | | |
|---|---|---|
| DE | 3607954 | 9/1987 |
| EP | 0225825 | 6/1987 |
| EP | 0415049 | 3/1991 |
| FR | 2677109 | 5/1992 |
| WO | WO 9606304 | 2/1996 |

* cited by examiner

*Primary Examiner*—James C. Yeung
(74) *Attorney, Agent, or Firm*—Piper Rudnick

(57) ABSTRACT

Gas cooking appliance comprising a gas burner equipped with a gas injector 1 fixed to a support 3 and a gas supply tube 2; the support is a sheet metal plate 3 with a through-aperture 4; the injector 1 is fixed to the end of the tube 2; the injector 1 and/or the tube 2 extend through the aperture 4 with the injector 1 and tube 2 one on each side of the plate 3; and a radial annular flange (6) is provided on the tube 2 and situated under the plate 3, being clamped in a sealed fashion against the peripheral edge of the aperture 4 and/or bearing surface 12 of the injector 1 so as to seal between the tube 2 and the injector 1 and between the top and the underside of the plate 3 around the edge of the aperture 4, and to hold the injector 1 secured to the tube 2 centrally in the aperture 4 in a predetermined axial position above the plate 3.

6 Claims, 3 Drawing Sheets

GAS COOKING APPLIANCE

FIELD OF THE INVENTION

The present invention relates to improvements made to domestic or professional gas cooking appliances, comprising at least one gas burner equipped with a gas injector which is screwed onto a gas supply tube, the said injector and/or the said tube being engaged through an aperture in a top plate to which the said injector is fixed; the injector and the tube are situated essentially one on each side of the support plate.

DESCRIPTION OF THE PRIOR ART

Traditionally, these appliances are arranged in such a way that each burner body is supplied with gas via a tube coming from an adjusting tap; the burner body is itself arranged with a pot-shaped part able to receive the removable injector.

To manufacture it, such an arrangement entails at least one operation of connecting the tube to the burner body and one operation of mounting the injector on the burner body. Each of these operations is followed by a leak test operation.

The search for a lower cost of manufacture of gas cooking appliances has led to the aforementioned traditional mounting process being reconsidered and a search for a simpler, swifter and therefore less expensive process.

SUMMARY OF THE INVENTION

The essential object of the invention is to propose an improved structure which makes it possible to simplify the methods of assembly, to speed up the assembly time and finally to reduce the cost of manufacture.

To these ends, a gas cooking appliance such as mentioned in the preamble is characterized, while being arranged in accordance with the invention, in that a radially extending annular flange is provided on the supply tube, which flange is situated under the support plate, and clamped in a sealed fashion against the peripheral edge of the aperture and/or bearing surface of the injector so that when the injector and the supply tube are being assembled, one on each side of the support plate, a seal is produced between the tube and the injector, on the one hand, and between the top and the underside of the support plate around the edge of the aperture, on the other hand, and at the same time to mechanically hold the injector secured to the supply tube in a centered position in the aperture with the outlet orifice of the injector situated in a predetermined axial position above the support plate. In a preferred embodiment, the injector and the end or the region near the end of the supply tube are threaded and are secured by being screwed together.

Thanks to the arrangements of the invention, there then remains only the single operation of directly assembling the injector with the supply tube, by screwing, the structures being such that this simple assembly brings collaborating surfaces together to correctly (axially and radially) position the injector with respect to the support plate and seals as required. What is more, the special structures employed for this, and a number of embodiments of which are indicated hereinafter, are obtained by simple machining operations, particularly forming or pressing, bending, etc, which are inexpensive and merely require equipment which is none too complex.

Such an arrangement may lead to various embodiments:

in one embodiment, the annular flange is situated beneath that end of the tube which is secured to the injector and the peripheral edge of the aperture is clamped in a sealed way between the said annular flange of the tube and a bearing surface of the injector, which surface is formed by the lower end of the injector or an annular shoulder surrounding the injector;

in another embodiment, the annular flange is situated beneath that end of the tube which is secured to the injector and the peripheral edge of the aperture is folded over and clamped in a sealed way between the said annular flange of the tube and a conical bearing surface provided around the injector;

in yet another embodiment, the annular flange is situated in close proximity to the end of the tube and above that part of the tube which is secured to the injector, and the end of the tube surmounting the annular flange is folded over to trap the peripheral edge of the aperture into contact with a conical bearing surface of the injector; in an alternative form of embodiment it is possible to envisage an elastic clip being inserted between the folded-over end of the tube and the support plate.

In a simple way, the flange may consist of a radially protruding annular fold of the wall of the tube.

The arrangements according to the invention seem to find a particularly advantageous, although not exclusive, application in the case where the support plate is none other than the top plate of the cooking appliance, in other words when the injector is secured directly to the top plate, which arrangement leads to the omission of the burner pot and any members there might be for mounting the injector in this pot. In such a field of application of the arrangements of the invention, this culminates in an overall structure which combines substantial structural and assembly simplifications and is therefore appreciably more economical than the structures of the prior art.

DETAILED DESCRIPTION OF THE INVENTION

Figure 1:
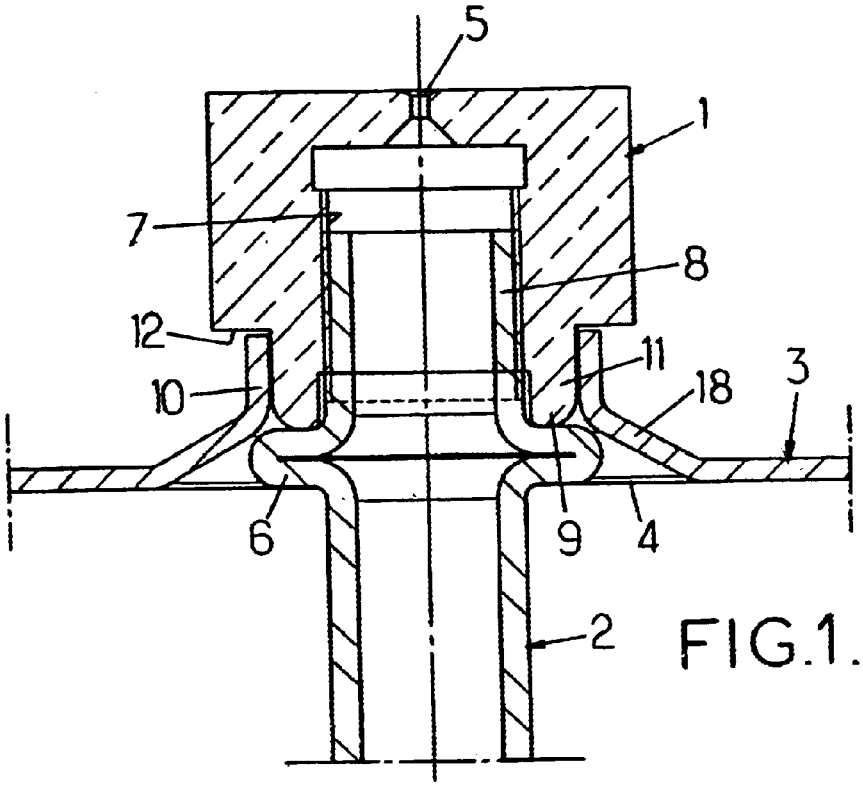
FIG. 1 is a cross-sectional view of a first embodiment of the present invention.

Referring first of all for example to FIG. 1, the invention relates to a gas cooking appliance comprising at least one gas burner equipped with a gas injector 1, a gas supply tube 2 coming from an adjusting tap and associated functionally with said injector 1, and a support 3 to which the said injector 1 is fixed.

The support 3 is a sheet metal plate which has a through-aperture 4. The said support plate 3 may, in a preferred although not exclusive embodiment, consist of the top plate of the cooking appliance which, in the context of the invention, is then used as a direct support for the injector under the conditions explained hereinafter: such an arrangement, which does away with the conventional burner pot in which the injector was hitherto fixed, leads to a remarkable simplification.

The injector 1 is secured to the supply tube 2 at the end or near the end thereof. As a preference, the injector 1 and the supply tube 2, at its end or near its end, are threaded and screwed together.

The injector 1 and/or the supply tube 2 extend through the aperture 4, and the injector 1 and the tube 2 essentially lie one on each side of the support plate 3.

Positioning and sealing means are provided on the injector 1 and/or the tube 2 and the peripheral edge of the aperture 4. These means are designed so that when the injector 1 and the tube 2 are assembled by screwing them together through the support plate 3, a seal is produced between the tube 2 and the injector 1, on the one hand, and between the top and the underside of the support plate 3 around the edge of the aperture 4, on the other hand. These same means are at the same time designed to mechanically hold the injector 1 secured to the supply tube 2 in the centered position in the aperture 4 and with the outlet orifice 5 of the injector 1 situated in a predetermined axial position above the support plate 3.

One simple embodiment of the positioning and sealing means consists in making them comprise a radially extending annular flange 6 secured to the supply tube 2. The flange 6 is situated under the support plate 3 and is clamped in a sealed fashion against the peripheral edge of the aperture 4 and/or a bearing surface of the injector 1. In a simple structure, the annular flange 6 is not attached to the tube 2, but is formed by an annular fold of the wall of the tube 2 which is pinched axially to form an annular projection or flange which is thus integral with the tube.

The foregoing arrangements may lead to various specific embodiments.

In FIG. 1, the injector 1 has an interior axial cavity 7 open towards the bottom and ending at the top in the outlet orifice or nozzle 5 of the injector. The cavity 7 is tapped.

As far as the supply tube 2 is concerned, its flange 6 lies set back somewhat beneath its end 8, and the external wall near its end 8 is threaded, with a diameter corresponding to that of the cavity 7 of the injector. The injector 1 is screwed onto the end 8 of the tube 2 in such a way that the frontal edge 9 of the injector 1 is trapped in a sealed fashion against the flange 6: this sealed bearing effect seals the connection between the injector and the supply tube.

To position the injector 1 on the support plate 3, the aperture 4 has its peripheral edge formed and deformed into a well 10 facing upwards. On its side, the injector 1 has its lower part 11 arranged with a smaller outside diameter which defines a radial annular shoulder 12.

The injector 1 is force-fitted, via its lower part 11, into the well 10 until the shoulder 12 comes to bear against the free edge of the well 10. The elastic trapping of the lower part 11 of the injector in the well 10 provides a sealed connection between the injector 1 and the support plate 3 and therefore ensures sealing between the top and the underside of the plate 3 along the peripheral edge of the aperture 4.

By virtue of this arrangement, the injector is also positioned in a predetermined way, transversely and axially, with respect to the plate 3.

In the embodiment of FIG. 1, the well 10 connects with the support plate 3 via a connecting portion 18 of frustoconical shape which, on the underside of the plate 3, leaves a space able to accommodate the flange 6 when the injector 1 is screwed onto the end of the tube 2.

Figure 2:
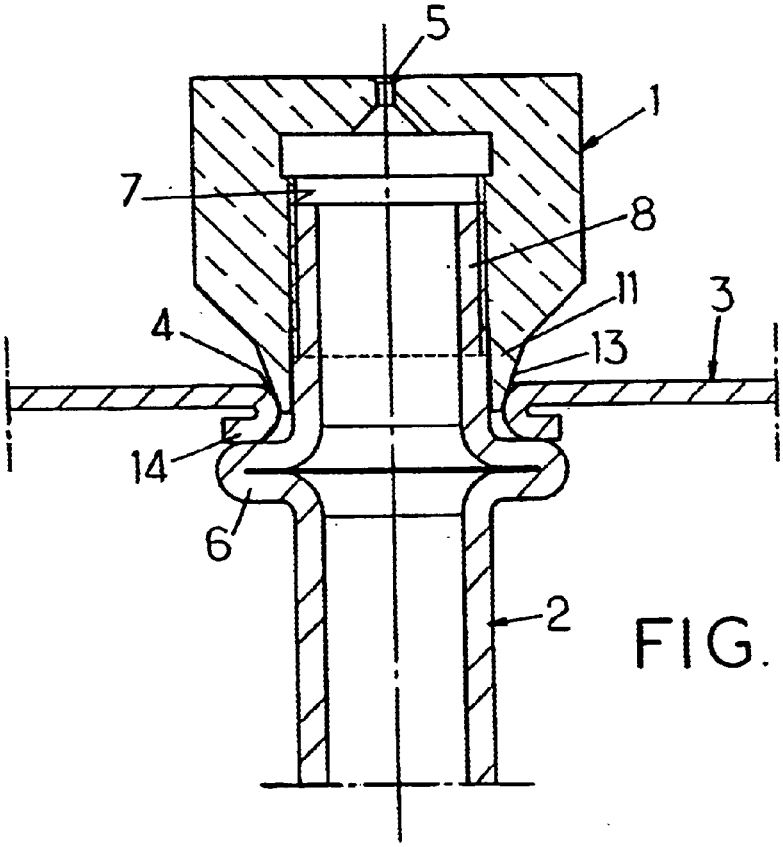
FIG. 2 is a cross-sectional view of a second embodiment of the present invention.

In the embodiment of FIG. 2, the injector 1 and the supply tube 2 are almost the same as they were in FIG. 1, except that the smaller-diameter lower part 11 of the injector has a frustoconical external shape 13, narrowing towards the bottom.

The peripheral edge of the aperture 4 is bent around on itself at 14, in this instance on the underneath.

When the injector 1 is screwed onto the end 8 of the tube 2, the conical wall 13 of the lower part of the injector 1 traps the bent-over edge 14 of the aperture 4 of the support plate 3 against the flange 6 of the tube. It is thus this bent-over edge 14 of the opening 4 which provides the two-fold sealing desired, on the one hand, through its approximately radial collaboration with the conical bearing surface 13 of the injector, and on the other hand, by its bearing axially on the flange 6 of the supply tube.

Figure 3:
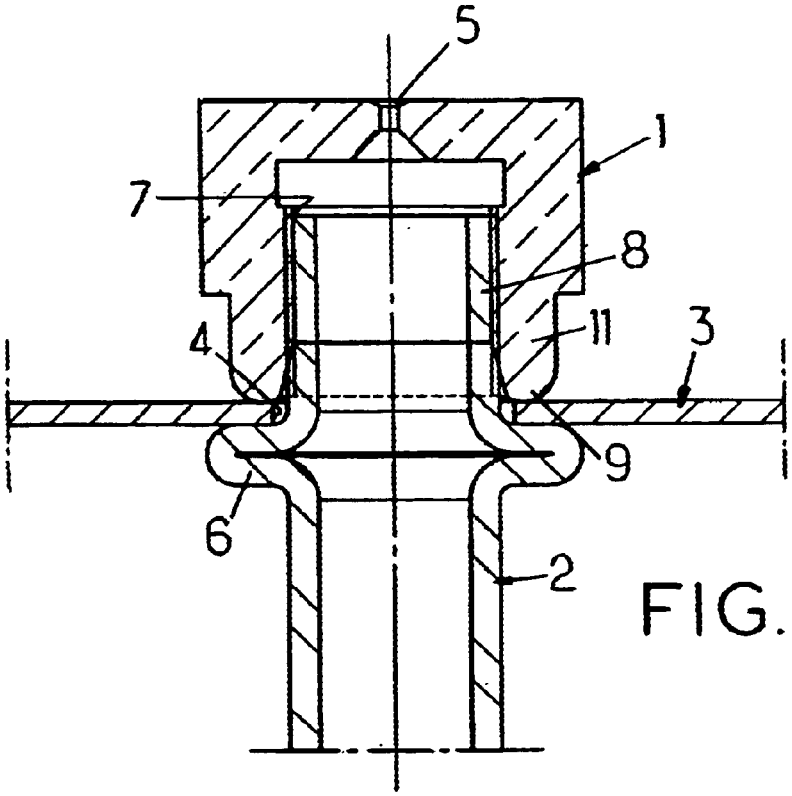
FIG. 3 is a cross-sectional view of a third embodiment of the present invention.

FIG. 3 illustrates a very simple embodiment in which the injector 1 and supply tube 2 are identical to how they were in FIG. 1. The aperture 4 in the support plate 3 is a straight-edge cutout made in the plate 3.

The edge of the aperture 4 is trapped between the frontal edge 9 of the injector and the flange 6 of the supply tube 2.

Here again, the straight edge of the aperture 4 provides the two-fold sealing required, on the one hand, through its axial collaboration with the frontal end of the injector 1 and, on the other hand, by its bearing axially on the flange 6 of the supply tube.

In the embodiment illustrated in FIG. 4, it is the smaller-diameter lower part 11 of the injector 1 which is externally threaded, while the supply tube 2 is tapped below its end.

Here, the flange 6 is formed at the end of the tube 2 and, as the injector 1 is screwed into the tube 2, the edge of the aperture 4 in the support plate 3 is trapped between the shoulder 12 offered by the injector 1 and the flange 6 of the supply tube.

The desired two-fold sealing is afforded by the flange 6 bearing axially against the plate 3, on the one hand, and by the shoulder 12 bearing axially against the plate 3, on the other hand.

Figure 4:
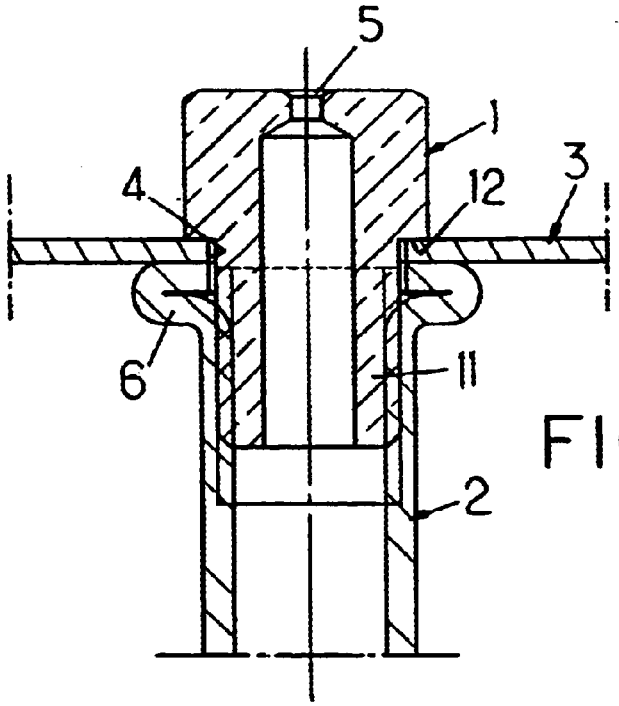
FIG. 4 is a cross-sectional view of a fourth embodiment of the present invention.
Figure 5:
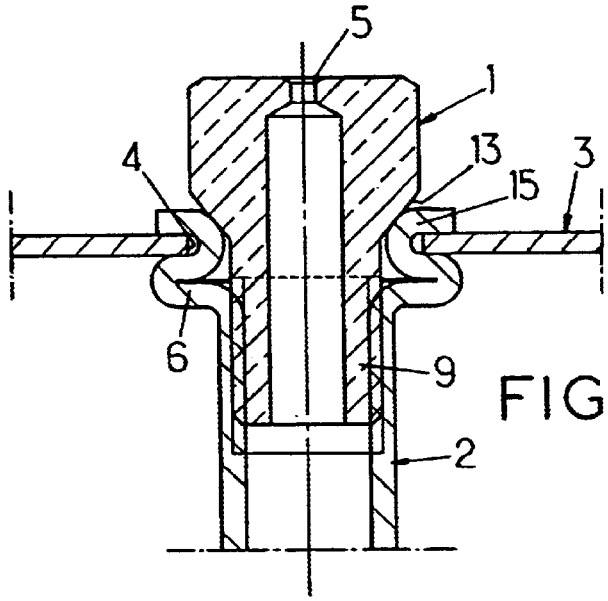
FIG. 5 is a cross-sectional view of a fifth embodiment of the present invention.

The embodiment of FIG. 5 is based on an arrangement similar to that of FIG. 4, except that the shoulder 12 of the injector 1 is replaced by a conical bearing surface 13 as in the embodiment of FIG. 2, and that the flange 6 lies set back from the end of the supply tube 2, which end is folded over peripherally to form an annular grip 15 trapping the straight edge of the aperture 4 in the support plate 3.

When the injector 1 is screwed into the tube 2, the conical bearing surface 13 of the injector presses against the grip 15 formed by the end of the tube 2 and flattens it onto the straight edge of the aperture 4.

The required sealing effects are achieved, on the one hand, by the approximately radial bearing of the conical bearing surface 13 on the grip 15 and, on the other hand, by the trapping of the straight edge of the aperture 4 between the folded-over (at 15) end of the tube 2 and the underlying flange 6.

Figure 6:
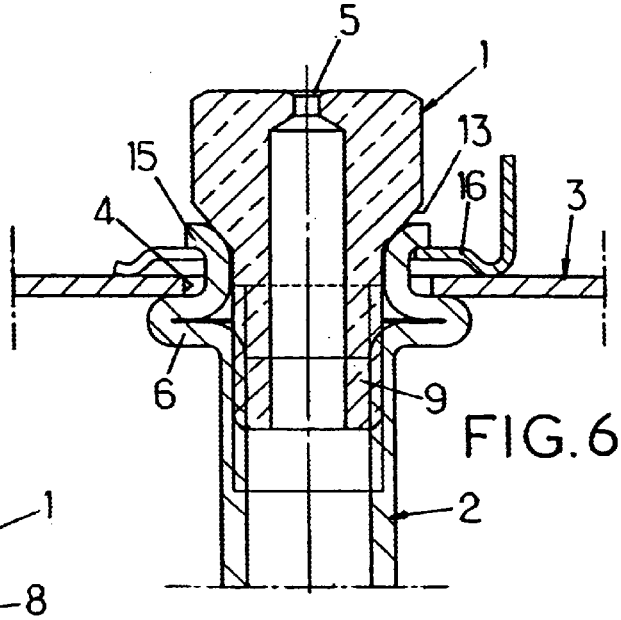
FIG. 6 is a cross-sectional view of a sixth embodiment of the present invention.

The embodiment of FIG. 6 is similar to that of FIG. 5 except that the end of the tube 2 which is folded over into an annular grip 15 bears on the underside of the support plate 3 via its flange 6 and, on the top of the plate, bears against an elastically deformable clip 16 in the form of a fork which brakes the injector 1 screwed into the tube 2.

Figure 7:
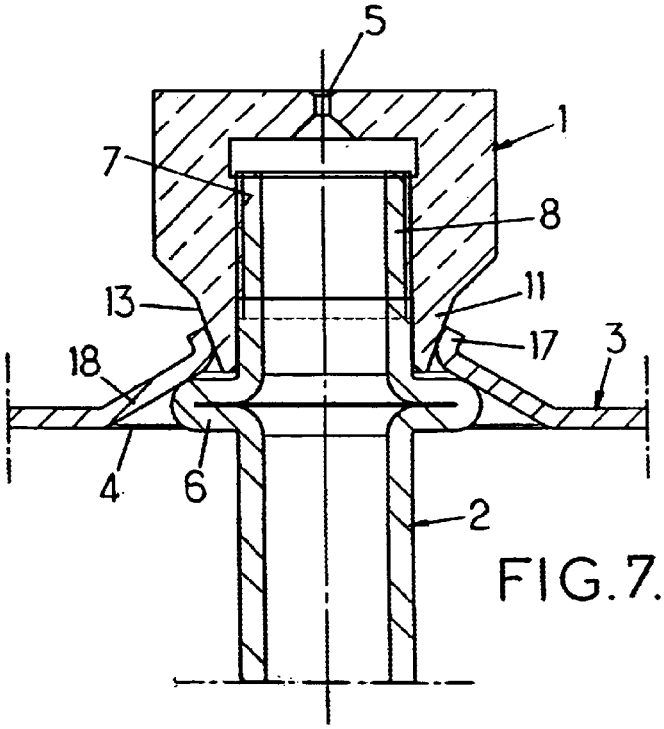
FIG. 7 is a cross-sectional view of a seventh embodiment of the present invention.

The embodiment of FIG. 7 returns to the general arrangements of FIG. 1 except that the lower part 11 of the injector 1 is provided with a conical bearing 13 and that the edge of the aperture 4 in the support plate 3 is not shaped into a well as it was in FIG. 1 but is bent over to form a rim 17 approximately parallel to the conical bearing surface 13.

When the injector 1 is screwed onto the end of the supply tube 2, the conical bearing surface 13 which collaborates with the rim 17 presses the frustoconical connecting portion 18 against the flange 6.

The two-fold sealing effect is afforded, on the one hand, by the collaboration between the conical bearing surface 13 of the injector 1 and the rim 17 of the edge of the aperture 4 and, on the other hand, by the collaboration between the conical connecting portion 18 surrounding the aperture 4 and the flange 6.

In any event, the injector 1 is arranged in correct predetermined centred and axial positions with respect to the support plate and to the aperture.

In other words, in the embodiments of FIGS. 3 and 4, the flange 6 is situated beneath (set back from) that end of the tube 2 which is secured to the injector and the peripheral edge of the aperture 4 is trapped in a sealed way between the said annular flange 6 and a bearing surface of the injector 1, which surface is formed by the frontal end 9 or an annular shoulder 12 of the injector 1.

Likewise, in the embodiments of FIGS. 2 and 7, the annular flange 6 is situated beneath (set back from) that end of the tube 2 which is secured to the injector and the peripheral edge of the aperture 4 is folded over and clamped in a sealed way between the said flange 6 and a conical bearing surface 13 provided around the injector 1.

Finally, in the embodiments of FIGS. 5 and 6, the annular flange 6 is situated in close proximity to the end of the supply tube 2 and above that part of the tube 2 which is secured to the injector 1, and the end of the tube 2 surmounting the flange 6 is bent over at 15 to trap (directly in FIG. 5; and by means of an elastic clip in FIG. 6) the peripheral edge of the aperture 4 in contact with a conical bearing surface 13 of the injector 1.

What is claimed is:

1. A gas cooking appliance comprising:

a support plate is provided with at least one aperture;

at least one gas burner is disposed in relation with said aperture and is provided with a gas injector having a bearing surface;

a gas supply tube has a side wall and an end portion a part of which is axially screwed to said injector;

one of said injector and said tube end portion is engaged though said aperture in said support plate, and said injector and tube end portion extend essentially one on each side of said support plate;

said side wall of said tube end portion is annularly folded so as to form a radially protruding annular flange integral with said tube end portion; and said annular flange is clamped in a sealed way against one of a peripheral edge of said aperture and said bearing surface of said injector, whereby, when said injector and said tube end portion are being assembled one on each side of said support plate, a seal is provided between said tube and said injector, and between the top and the underside of said support plate around the edge of said aperture, and whereby simultaneously said injector secured to said tube end portion is mechanically hold in a centered position in said aperture with an outlet orifice of said injector situated in a predetermined axial position above said support plate.

2. The appliance according to claim 1, wherein said annular flange is situated beneath said part of said tube end portion screwed to said injector, and wherein the peripheral edge of said aperture is clamped in a sealed way between said annular flange of said tube end portion and said bearing surface of said injector which is one of a lower end of said injector and an annular shoulder surrounding said injector.

3. The appliance according to claim 1, wherein said annular flange is situated beneath said part of said tube end portion screwed to said injector, and wherein the peripheral edge of said aperture is folded over and clamped in a sealed way between said annular flange of said tube and said bearing surface of said injector shaped as a conical surrounding surface.

4. The appliance according to claim 1, wherein said annular flange is situated in close vicinity to the end of the tube and above said part of the tube end portion screwed to the injector, and wherein said end of the tube surmounting said annular flange is folded over to trap the peripheral edge of said aperture in contact with said bearing surface of said injector shaped as a conical surrounding surface.

5. The appliance according to claim 4, wherein an elastic clip is inserted between said folded-over end of said tube and said support plate.

6. The appliance according to claim 1, wherein said support plate is a top plate of said appliance.

* * * * *